US007143533B2

(12) United States Patent
Burke

(10) Patent No.: US 7,143,533 B2
(45) Date of Patent: Dec. 5, 2006

(54) MOTOR VEHICLE DECAL DISPLAY SYSTEM

(76) Inventor: Malcolm A. M. Burke, 4917 Jamestown Rd., Bethesda, MD (US) 20816

( * ) Notice: Subject to any disclaimer, the term of this patent is extended or adjusted under 35 U.S.C. 154(b) by 52 days.

(21) Appl. No.: 10/950,408

(22) Filed: Sep. 28, 2004

(65) Prior Publication Data

US 2005/0034340 A1 Feb. 17, 2005

Related U.S. Application Data

(63) Continuation of application No. 10/615,066, filed on Jul. 9, 2003, now abandoned.

(51) Int. Cl.
*G09F 21/04* (2006.01)

(52) U.S. Cl. ..... 40/591; 40/491; 40/593

(58) Field of Classification Search ..... 40/591, 40/593, 488–491, 508, 509, 513, 481; 340/481–484, 340/485; 116/50
See application file for complete search history.

(56) References Cited

U.S. PATENT DOCUMENTS

| | | | | |
|---|---|---|---|---|
| 1,233,646 | A * | 7/1917 | Cook | 340/484 |
| 1,414,521 | A * | 5/1922 | Michalski | 40/626 |
| 1,650,845 | A * | 11/1927 | McKee | 40/481 |
| 1,846,649 | A * | 2/1932 | McFarland | 40/491 |
| 1,848,927 | A * | 3/1932 | Beach | 340/482 |
| 2,776,638 | A * | 1/1957 | Whitaker | 116/324 |
| 4,864,754 | A | 9/1989 | Sangu | |
| 6,182,599 | B1 | 2/2001 | Sung | |

* cited by examiner

*Primary Examiner*—Cassandra Davis
(74) *Attorney, Agent, or Firm*—Min, Hsieh & Hack, LLP

(57) ABSTRACT

A display device for a motor vehicle may comprise at least one housing configured to be disposed within an interior of the motor vehicle and at least one support removably mountable relative to the at least one housing and configured to support an item for display from the interior of the motor vehicle. When mounted relative to the at least one housing, the at least one support is configured to be selectively moveable between a first position wherein the at least one support is retracted within the housing such that the item for display is not viewable from outside the motor vehicle and a second position wherein the at least one support is extended outside the housing such that the item for display is viewable from outside the motor vehicle.

20 Claims, 3 Drawing Sheets

MOTOR VEHICLE DECAL DISPLAY SYSTEM

CROSS REFERENCE TO RELATED APPLICATION

This application is a continuation application and applicant hereby claims the benefit of application Ser. No. 10/615,066, filed Jul. 9, 2003, now abandoned entitled "Motor vehicle decal display system" which is incorporated by reference herein in its entirety.

STATEMENT REGARDING FEDERALLY SPONSORED RESEARCH OR DEVELOPMENT

NOT APPLICABLE

REFERENCE TO SEQUENCE LISTING, ETC.

NOT APPLICABLE

BACKGROUND OF THE INVENTION

The present invention relates to a device for the display of decals, stickers, labels, placards, automatic toll paying devices, remote control garage door openers, or other like items so they are visible through the windows of a motor vehicle and accessible from within the passenger compartment of the motor vehicle. More particularly, the present invention relates to an apparatus and means of activating, controlling; and managing the display of said decals, stickers, placards, or similar items affixed to decal display plates, so that they may be exposed when the car is parked, and removed from view when the motor vehicle is being operated, vice-versa, or so that the display of said decals, stickers, labels, placards, or similar items may be made depending on other operating status of the motor vehicle, at the motor vehicle operator's discretion, or by reception of activating signals. Additionally, the present invention allows for the easy removal and/or replacement of said decals, stickers, labels, placards, or similar items, by means of removable decal display plates.

It is common for federal, state, municipal, and local governments, as well as clubs, residential associations, private beaches, parking lots, schools, businesses, or other organizations or entities to require the display of certain decals, stickers, labels, placards, or similar items in the windows of motor vehicles, particularly automobiles, to indicate the particular automobile owner or operator's compliance with registration, inspection, residency, membership, affiliation, enrollment, or other obligations, or to otherwise indicate the particular status of the motor vehicle or the owner or operator thereof pertinent to the particular authority or organization. Present means and methods of displaying these decals, stickers, labels, placards, or similar items, provides that the decals, stickers, labels, placards, or similar items be affixed or placed directly on the interior or exterior surface of the windshield glass, or the glass of certain other windows of the motor vehicle, or to the forward-facing portion of the rear view mirror.

There are inherent disadvantages to a means and method of decal, sticker, label, placard, or similar item display that does not allow for exposure of said decals, stickers, labels, placards, or similar items at the discretion of the motor vehicle operator, or automatically, given the particular nature of the motor vehicle's operation. Specifically, the prior art creates a situation in which the operator of a motor vehicle, upon the windows of which have been affixed or placed certain decals, stickers, labels, placards, or similar items, has a reduced field of vision through said windows. As a particular motor vehicle may have multiple decals, stickers, labels, placards, or similar items affixed or displayed to its windows, the field of vision of that motor vehicle's operator may be significantly compromised. This compromised field of vision may not have been accounted for by the designer of said motor vehicle, and jeoprardizes the operator's ability to operate the motor vehicle in the safest manner possible. Moreover, by not being able to direct the display of certain decals, stickers, labels, placards, or similar items, the motor vehicle operator may be disclosing information to passersby that he or she would rather keep confidential, and, if affixed to the exterior of a motor vehicle's window, the decal, sticker, label, placard, or similar items is vulnerable to theft or mutilation. Additionally, as time passes and replacement decals are issued by various authorities or organizations, it becomes necessary to remove and/or replace the decals, stickers, labels, placards, or similar items affixed to the windows. At times this may be very difficult due to the awkward positioning of the decals, stickers, labels, placards, or similar items, as well as to the condition of the adhesive which affixed the decal, as it has been effected by sunlight and other elements affecting the window. Finally, the prior art creates a situation where the operator of a motor vehicle cannot transfer decals, stickers, labels, placards, or similar items which have been affixed to a window from one motor vehicle to another. (For example, in cases where a motor vehicle must be repaired, and the operator uses another, temporary motor vehicle, it would be advantageous to transfer a parking decal to the temporary motor vehicle.) It is to these failures of the prior art, among others, to which the present invention is drawn.

BRIEF SUMMARY OF THE INVENTION

The present invention provides a system for activating, controlling, and managing the display of decals, stickers, labels, placards, or similar items through the windows of a motor vehicle. The motor vehicle decal display system will comprise a single, or multiple decal display plates upon which decals, stickers, labels, placards, or similar items may be affixed and housed within single or multiple housing units. One or more of these decal display plates and concomitant housing units may be designed to accept an automatic toll-paying device. The location of these decal plate housing units will be within the interior of the motor vehicle and near those areas of the windows of a motor vehicle which have traditionally been used to display decals, stickers, labels, placards, or similar items (e.g.: the edges of the front windshield, particularly the corners thereof; the edges of the rear window, particularly the corners thereof; the forward-facing surface of the rear view mirror; and such other places as may be deemed appropriate for display of decals, stickers, labels, placards, or similar items). These decal display plates may be retracted into the housing units, which in turn would be recessed in that space between the interior and exterior body panels of the motor vehicle, or below the surface of the vehicle's dashboard, thereby concealing display of any decals affixed thereto. The motor vehicle decal display system will also comprise a single or multiple switches, buttons or other means of manual or sensate activation, whereby the position of the decal plates (either exposed or retracted) can be managed and thereby the display of certain decals, stickers, labels, placards, or similar items through the windows of a motor vehicle may be engaged as directed by the operator, or may be programmed to be displayed automatically given the particular nature of the vehicle's operation. Additionally, the motor vehicle decal display system may include the circuitry, receivers, and other elements necessary to allow the automatic exposure and retraction of the decal display plates in response to outside stimuli (such as transmissions from radio transmitters, blue-tooth technology, or other communications devices), or based on the vehicle's position on the earth's surface as determined by signals from a global positioning system ("GPS") device. Additionally, the motor vehicle decal display system will comprise a means of removing and/or replacing the decal plates, to allow for easier removal of the decals affixed thereto, or for the replacement or transfer of the decal display plates altogether.

The switch or other means of activation and the circuitry connected thereto will allow for the programming of a particular decal plate in a multitude of ways, including: 1) to always be retracted during operation of the motor vehicle, or in some other nature or manner of operation, while automatically being extended or exposed when the motor vehicle is engaged in the "parked" gear, or in some other nature or manner of operation, (i.e.: while the car is unoccupied, the key is not inserted in the ignition, the engine is not running, the vehicle's alarm is armed, etc, etc.), (herinafter termed, for ease of reference, "diplayed when parked"); and 2), to always be retracted while the motor vehicle is engaged in the "parked" gear, or in some other nature or manner of operation while automatically exposed during operation of the motor vehicle (i.e.: while the car is occupied, the key is inserted in the ignition, the engine is running, the vehicle's alarm is disarmed, etc, etc.), (herinafter termed, for ease of reference, "diplayed when driving"). The advantage to this invention is that it allows for the display of certain decals, stickers, labels, placards, or similar items through the windows of a motor vehicle, only when the viewing thereof is possible, warranted, or desired by the operator, (displayed when parked versus displayed when driving), and thereby the operator's field of vision through the windows of the motor vehicle will not be needlessly impaired.

The activation of the decal display plate may also be activated automatically by internal or external transmissions or influences on the motor vehicle. For example, when the motor vehicle approaches a parking garage for which it has a parking pass or decal, a transmitter at the garage may activate, through the use of blue-tooth, radio or cellular frequency, or other signal transmission, the exposure of the decal display plate upon which the parking pass is affixed, and thereby expose the parking pass. Such a result may be accomplished by the inclusion of a receiver that would detect the outside stimuli and activate the circuitry to effect the decal display plates. Similar activation from the exterior of the motor vehicle would be advantageous for use of automatic toll-paying devices such as "SpeedPass" and "EZPass" in conjunction with the present invention. Additionally, the decal display plate system could be designed to receive signals from a GPS device and thereby be programmed to expose and retract certain decal display plates depending upon the motor vehicle's position on the earths surface.

Previously, the operator of a motor vehicle could not manage the display of decals, stickers, labels, placards, or similar items, as described above. The present invention allows for this management, makes operation of the motor vehicle safer, limits discosure of certain information, and makes replacement/removal of decals, stickers, labels, placards, or similar items easier.

BRIEF DESCRIPTION OF THE SEVERAL DRAWINGS

DETAILED DESCRIPTION OF THE INVENTION

Figure 1:
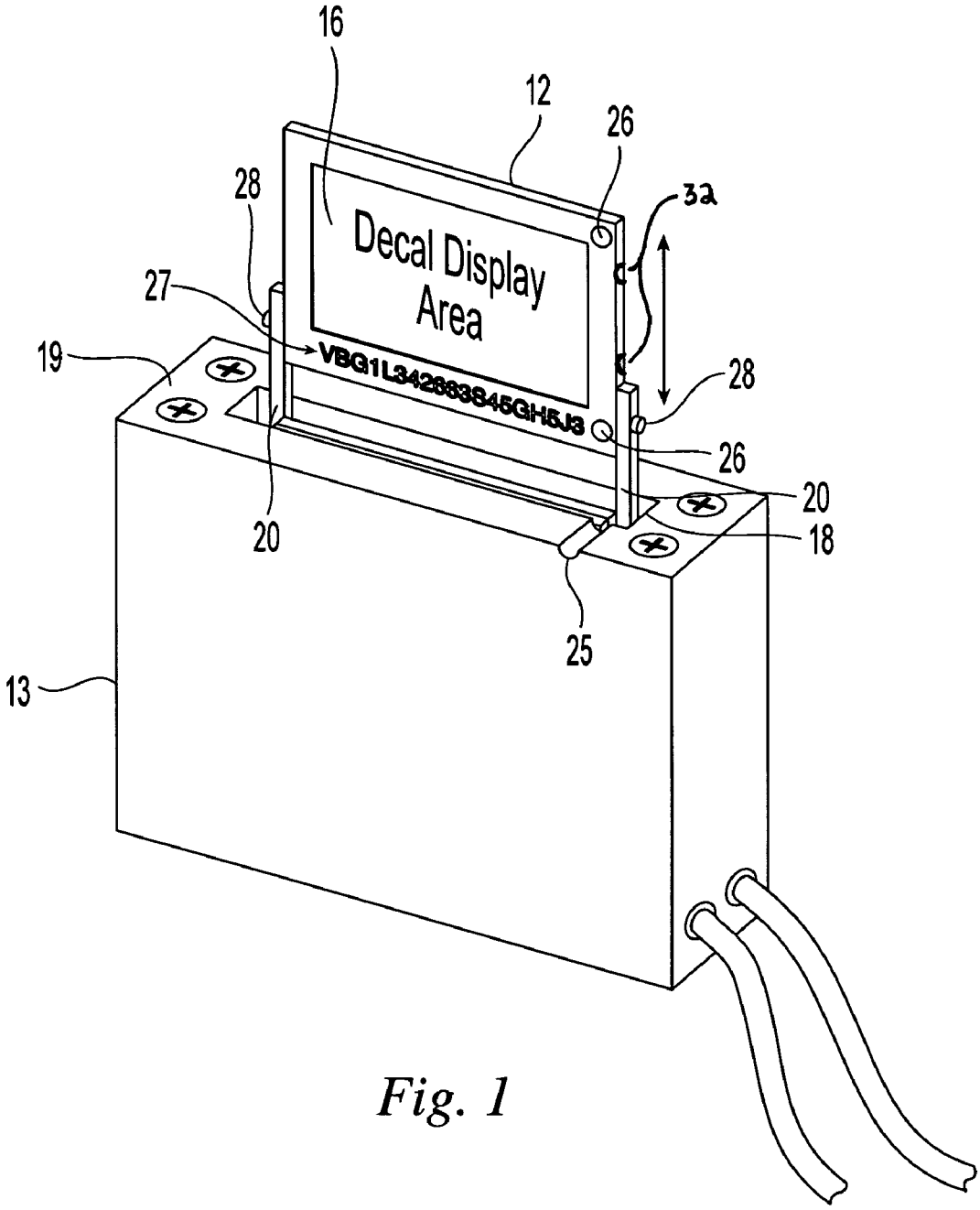
FIG. 1 is a perspective view of one housing unit and decal display plate of the decal display system according to the present invention.

This invention consists of a plurality of decal display plates 12, housed within a plurality of decal display plate housing units 13, the operation of which may be managed by a plurality of buttons, switches, 31 or other means of sensate activation of a plurality of electric motors 21 within the housing units 13, and the circuitry 22 to so control the activation and exposure or retraction of decal display plates 12, from within a plurality of decal display plate housings 13, in a manner consistent with the operator's discretion. This invention is an improvement to the areas immediatetly surrounding the windshield 14 and other windows of the motor vehicle 15.

Figure 4:
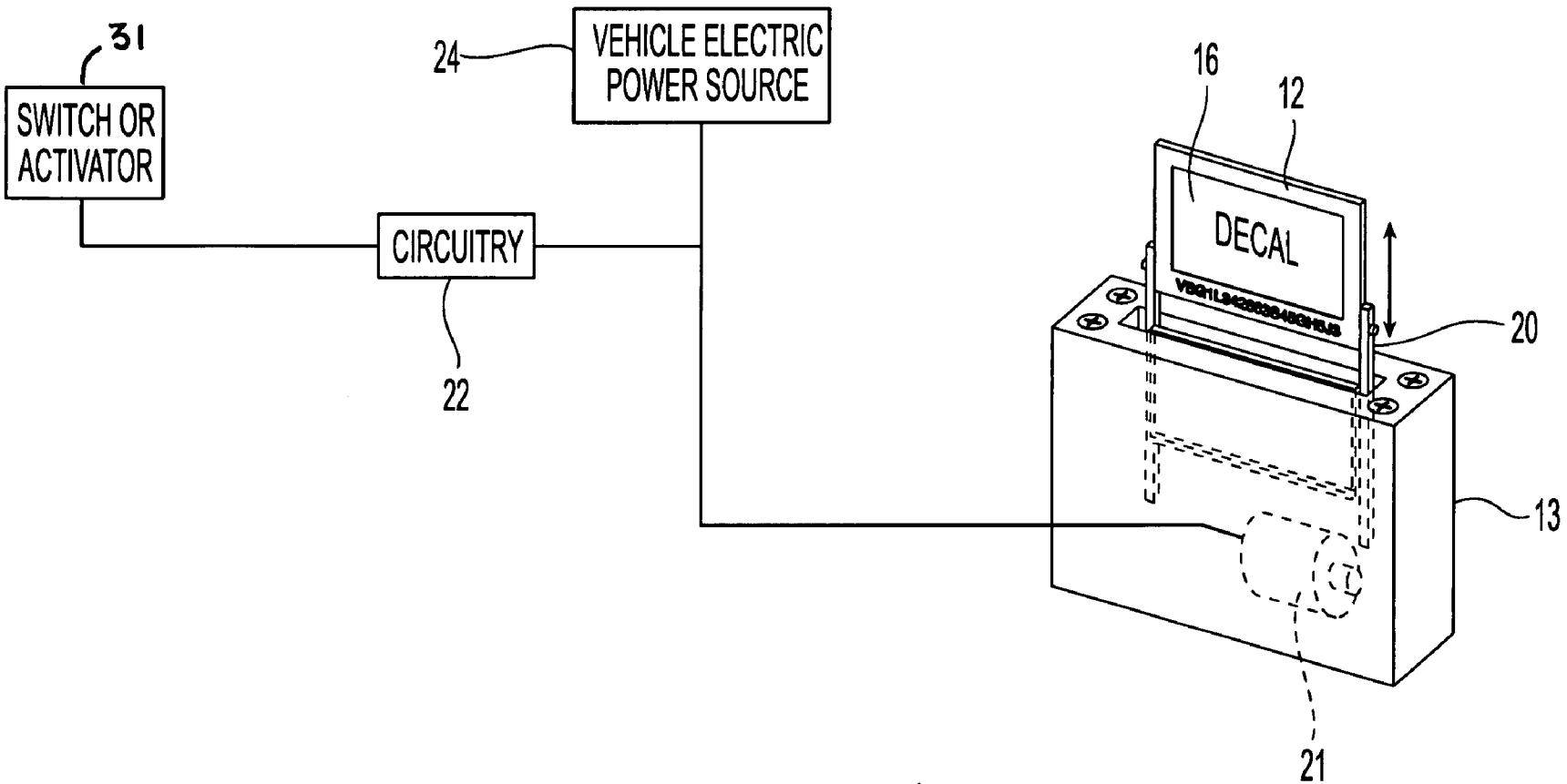
FIG. 4 is perspective view of one housing unit of the decal display system with interior portions and elements represented by hidden lines.

As FIGS. 1 and 4 illustrate, the best mode of design and composition for the individual decal display plates 12 is that of a clear plastic or safety glass plate, of minimal thickness (approximating ⅛.sup.th of an inch thick, and measuring approximately six (6) inches wide by four (4) inches long, with a decal display area 16 of approximately five (5) inches by three (3) inches. Also, the decal display plate 12 may be inscribed with the vehicle identification number ("VIN") of its host vehicle 27 so as to frustrate attempts to transfer decals, the issuers of which desire to be used on a particular vehicle. Within each housing 13 could be stacked several decal plates 12, to allow for the display of different decals which need not be displayed simultaneously, or a single decal plate 12. The mechanism by which the selected decal plates 12 may be retracted into, or exposed from, the housing 13 may consist of a pair of rails or tracks 20 along the interior edge 18 of the opening on the top surface 19 of the housing unit 13, within which the decal plate 12 is seated. When activated, the decal plates 12 are exposed by activation of an electrical motor or device 21, connected to the vehicle's electric power source 24 that pushes the decal plate 12 from the housing 13. This is most easily performed by connecting the decal plate housing 13, and the device that exposes the decal plate 21 to the vehicle's electrical power supply 24 through circuitry 22 which may be completed by the activation of the above-described button or switch. Additionally, the housing unit 13 provides for manual override operation, through the inclusion of a small opening 25 in the housing 13 and opening 26 in the decal display plate 12, into which could be placed an article, like a pen or key to-push the tracks 20, and thereby expose or retract the decal plate 12. Finally, the tracks 20 and decal display plate 12 provide a means of removing, and replacing decal plates 12. This is readily accomplished by the inclusion of a plurality of spring loaded ball bearings 28 within the tracks 20 which would seat within depressions 32 incorporated within the corresponding sides of the decal display plates 12.

Figure 2:
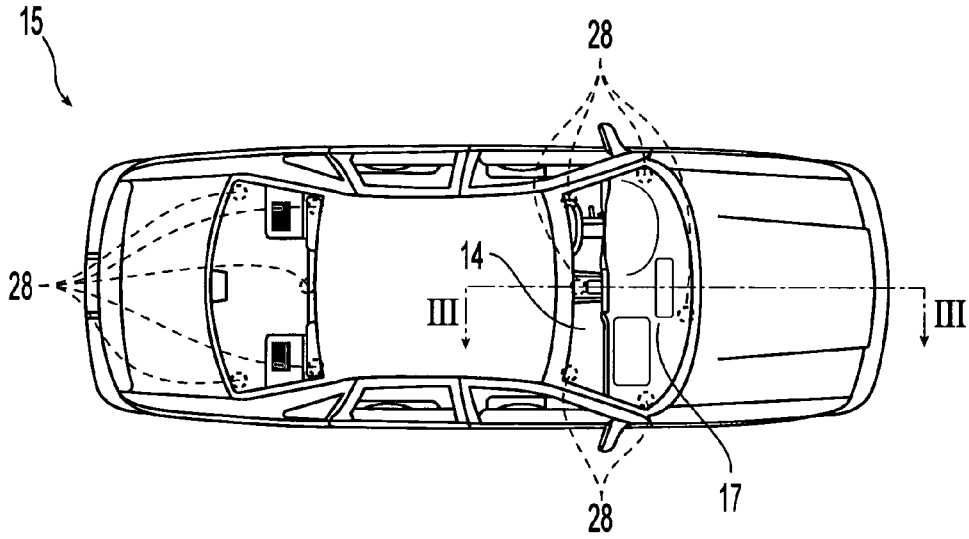
FIG. 2 is an overhead perspective view of a motor vehicle.
Figure 3:
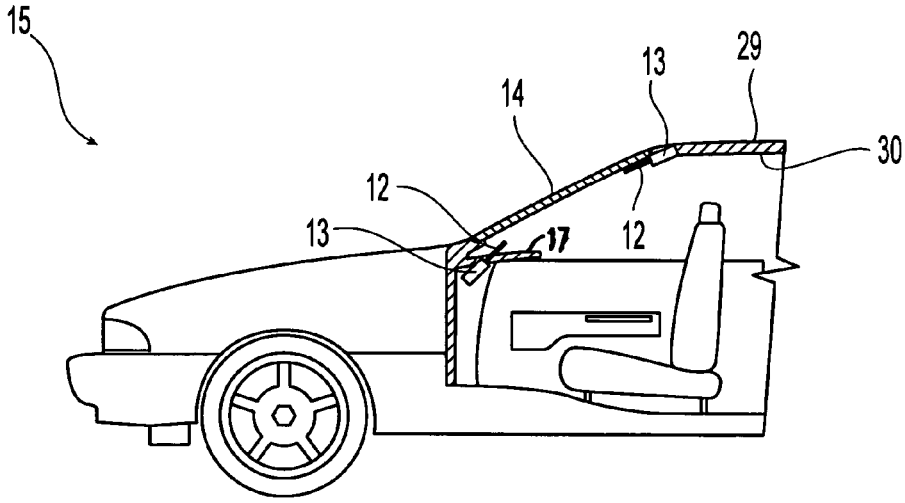
FIG. 3 is a cross sectional view of a motor vehicle taken along the line III—III of FIG. 2.

As FIGS. 2 and 3 illustrate, multiple housing units 13 may be installed at the perimeter of the windshield 14 and near the dashboard 17, and other locations 28 near the other windows of the motor vehicle 15, allowing the operator to display decals at particular locations, as presecribed by the pertinent authorities, or issuers of the decals, as the case may be. (For example, in Washington D.C., motor vehicle operators are directed to place their vehicle registration decal in the lower left-hand corner of the driver's side of the windshield when viewed from the interior of the motor vehicle.) Further, when exposed or extended from the decal display plate housing 13, the decal display plates 12 would be oriented in such a manner as to prevent their vibration against, or contact with, the motor vehicle's 15 windows or windshield 14.

As FIG. 3 illustrates, the best mode of use of the decal plate housing(s) 13 is for the placement thereof beneath the surface of the dashboard 17 of the motor vehicle 15, with a non-obtrusive and discrete appearance. The decal plate 12 may also be housed within this decal plate housing 13 recessed between the interior and exterior body panels of the motor vehicle. (For example, between the exterior roof panel 29 of the motor vehicle 15 and the interior ceiling panel 30 of the motor vehicle 15 for the display of decals through the windshield 14.)

While the invention has been described with particular reference to a best mode, it will be understood by those skilled in the art that various changes may be made and equivalents may be substituted for elements of the best mode without departing from the invention. For example, many modifications may be made to adapt a particular situation and material to a teaching of the invention without departing from the essential teachings of the present invention.

As is evident from the foregoing description, certain aspects of the invention are not limited to the particular details of the examples illustrated, and it is therefore contemplated that other modifications and applications will occur to those skilled the art. For example, items other than decals, stickers, labels, placards, and toll paying devices may affixed to the decal plates. Also, the exact means of activation and operation of the decal plates may be accomplished in a multitude of ways including, but not limited to, location based technologies (i.e., GPS, blue-tooth or radio transmission) or sensate activation (i.e., voice recognition). It is accordingly intended that the claims shall cover all such modifications and applications as do not depart from the true spirit and scope of the invention.

I claim:

1. A display device for a motor vehicle, the device comprising:

at least one housing configured to be disposed within an interior of the motor vehicle;

at least one support removably mountable relative to the at least one housing and configured to support an item for display from the interior of the motor vehicle; and at least one retractable mechanism coupled to the housing and moveable relative to the housing, the at least one support being configured to be removably coupled to the at least one retractable mechanism, wherein, when mounted relative to the at least one housing, the at least one support is configured to be selectively moveable between a first position wherein the at least one support is retracted within the housing such that the item for display is not viewable from outside the motor vehicle and a second position wherein the at least one support is extended outside the housing such that the item for display is viewable from outside the motor vehicle, and wherein the at least one retractable mechanism comprises one of a pair of rails and a pair of tracks.

2. A display device for a motor vehicle, the device comprising:

at least one housing configured to be disposed within an interior of the motor vehicle; and at least one support removably mountable relative to the at least one housing and configured to support an item for display from the interior of the motor vehicle, wherein, when mounted relative to the at least one housing, the at least one support is configured to be selectively moveable between a first position wherein the at least one support is retracted within the housing such that the item for display is not viewable from outside the motor vehicle and a second position wherein the at least one support is extended outside the housing such that the item for display is viewable from outside the motor vehicle, wherein the item for display comprises at least one of remote control entry devices and automatic toll paying devices.

3. A display device for a motor vehicle, the device comprising:

a plurality of separate housings configured to be disposed within an interior of the motor vehicle;

a plurality of supports configured to be removably mountable relative to the plurality of housings and configured to support an item for display from the interior of the motor vehicle, wherein, when mounted relative to housings, the supports are configured to be selectively moveable between a first position wherein the supports are retracted within the housing such that the item for display is not viewable from outside the motor vehicle and a second position wherein the supports are extended outside the housing such that the item for display is viewable from outside the motor vehicle.

4. A display device for a motor vehicle, the device comprising:

at least one housing configured to be disposed within an interior of the motor vehicle;

at least one support removably mountable relative to the at least one housing and configured to support an item for display from the interior of the motor vehicle, wherein, when mounted relative to the at least one housing, the at least one support is configured to be selectively moveable between a first position wherein the at least one support is retracted within the housing such that the item for display is not viewable from outside the motor vehicle and a second position wherein the at least one support is extended outside the housing such that the item for display is viewable from outside the motor vehicle, and wherein the device is programmable so as to automatically move the at least one support between the first position and the second position in response to a nature or manner of operation of the motor vehicle.

5. The display device of claim 4, further comprising at least one retractable mechanism coupled to the housing and moveable relative to the housing, the at least one support being configured to be removably coupled to the at least one retractable mechanism.

6. The display device of claim 4, wherein the item for display comprises at least one of decals, placards, stickers, and labels.

7. The display device of claim 4, wherein the at least one support comprise a plurality of supports.

8. The display device of claim 7, wherein the plurality of supports are configured to be removably mountable relative to the at least one housing.

9. The display device of claim 7, wherein each support is configured to receive a differing item for display from the interior of the motor vehicle.

10. The display device of claim 7, wherein the at least one housing is configured to be mounted between an interior panel and an exterior panel of the motor vehicle.

11. The display device of claim 10, wherein the at least one housing is configured to be mounted between an interior ceiling panel and an exterior roof panel of the motor vehicle.

12. The display device of claim 7, wherein the at least one housing is configured to be mounted below a surface of a dashboard of the motor vehicle.

13. The display device of claim 7, wherein the at least one support is configured to be viewable from exterior to the motor vehicle through a window of the motor vehicle when the at least one support is in the second position.

14. The display device of claim 13, wherein the at least one support is configured to be viewable through at least one of a front window and a back window of the motor vehicle when the at least one support is in the second position.

15. The display device of claim 7, further comprising at least one actuator configured to be selectively actuated to move the at least one support between the first position and the second position.

16. The display device of claim 7, wherein the at least one support is configured to automatically move between the first position and the second position in response to a transmitted signal.

17. The display device of claim 16, wherein the signal includes at least one of a data signal received from a global position satellite unit, a radio signal, a cellular signal, a blue tooth signal, and an electrical signal.

18. The display device of claim 7, wherein the housing defines a chamber and the at least one support is configured to be retracted within the chamber in the first position and extended out of the chamber in the second position.

19. The display device of claim 7, wherein the at least one support comprises a plate.

20. The display device of claim 19, wherein the plate comprises a portion configured to be permanently inscribed with identification data.

* * * * *

UNITED STATES PATENT AND TRADEMARK OFFICE

CERTIFICATE OF CORRECTION

PATENT NO. : 7,143,533 B2
APPLICATION NO. : 10/950408
DATED : December 5, 2006
INVENTOR(S) : Malcolm A.M. Burke It is certified that error appears in the above-identified patent and that said Letters Patent is hereby corrected as shown below:

Col. 7 Claim 10, line 1, delete "7" and insert therefor --4--.

Col. 7 Claim 12, line 1, delete "7" and insert therefor --4--.

Col. 7 Claim 13, line 1, delete "7" and insert therefor --4--.

Col. 8 Claim 15, line 1, delete "7" and insert therefor --4--.

Col. 8 Claim 16, line 1, delete "7" and insert therefor --4--.

Col. 8 Claim 18, line 1, delete "7" and insert therefor --4--.

Col. 8 Claim 19, line 1, delete "7" and insert therefor --4--.

Signed and Sealed this

Twenty-second Day of January, 2008

JON W. DUDAS
*Director of the United States Patent and Trademark Office*